US012139688B2

(12) United States Patent
Soma et al.

(10) Patent No.: US 12,139,688 B2
(45) Date of Patent: Nov. 12, 2024

(54) BALL SCREW GREASE COMPOSITION FOR RACK-ASSISTED ELECTRIC POWER STEERING

(71) Applicant: KYODO YUSHI CO., LTD., Fujisawa (JP)

(72) Inventors: Minami Soma, Fujisawa (JP); Tsuyoshi Kochi, Suzuka (JP); Tomonobu Komoriya, Chigasaki (JP)

(73) Assignee: KYODO YUSHI CO., LTD., Fujisawa (JP)

( * ) Notice: Subject to any disclaimer, the term of this patent is extended or adjusted under 35 U.S.C. 154(b) by 0 days.

(21) Appl. No.: 17/910,379

(22) PCT Filed: Mar. 30, 2021

(86) PCT No.: PCT/JP2021/013506
§ 371 (c)(1),
(2) Date: Sep. 9, 2022

(87) PCT Pub. No.: WO2021/200930
PCT Pub. Date: Oct. 7, 2021

(65) Prior Publication Data

US 2023/0139040 A1 May 4, 2023

(30) Foreign Application Priority Data

Mar. 31, 2020 (JP) ..... 2020-062060

(51) Int. Cl.

| | |
|---|---|
| ***C10M 169/00*** | (2006.01) |
| ***C10M 107/02*** | (2006.01) |
| ***C10M 115/08*** | (2006.01) |
| ***C10M 129/40*** | (2006.01) |
| ***C10M 129/74*** | (2006.01) |
| ***C10M 135/10*** | (2006.01) |
| *C10N 30/02* | (2006.01) |
| *C10N 40/04* | (2006.01) |
| *C10N 50/10* | (2006.01) |

(52) U.S. Cl.
CPC ..... *C10M 169/00* (2013.01); *C10M 107/02* (2013.01); *C10M 115/08* (2013.01); *C10M 129/40* (2013.01); *C10M 129/74* (2013.01); *C10M 135/10* (2013.01); *C10M 2205/0206* (2013.01); *C10M 2207/126* (2013.01); *C10M 2207/283* (2013.01); *C10M 2215/1026* (2013.01); *C10M 2219/044* (2013.01); *C10N 2030/02* (2013.01); *C10N 2040/04* (2013.01); *C10N 2050/10* (2013.01)

(58) Field of Classification Search
CPC ..... C10M 169/00; C10M 107/02; C10M 115/08; C10M 129/40; C10M 129/74; C10M 135/10; C10M 2205/0206; C10M 2207/126; C10M 2207/283; C10M 2215/1026; C10M 2219/044; C10N 2030/02; C10N 2040/04; C10N 2050/10
See application file for complete search history.

(56) References Cited

U.S. PATENT DOCUMENTS

| | | | | |
|---|---|---|---|---|
| 9,090,848 | B2 | 7/2015 | Nogami et al. | |
| 10,920,163 | B2 | 2/2021 | Hirooka et al. | |
| 2002/0002119 | A1 | 1/2002 | Naka et al. | |
| 2006/0154831 | A1 | 7/2006 | Iwano | |
| 2006/0264338 | A1 | 11/2006 | Kawamura et al. | |
| 2007/0149422 | A1 | 6/2007 | Miyajima et al. | |
| 2009/0003742 | A1* | 1/2009 | Nakatani | B60B 27/0005 508/552 |
| 2009/0065287 | A1 | 3/2009 | Kuwabara et al. | |
| 2009/0247435 | A1* | 10/2009 | E | C10M 159/18 508/370 |
| 2011/0041638 | A1 | 2/2011 | Fujinami et al. | |
| 2011/0136709 | A1 | 6/2011 | Tanaka et al. | |
| 2011/0160105 | A1* | 6/2011 | Tanaka | C10M 129/44 508/144 |
| 2011/0168479 | A1 | 7/2011 | Nakata et al. | |
| 2013/0157915 | A1* | 6/2013 | Azuma | C10M 141/10 508/408 |
| 2014/0045733 | A1 | 2/2014 | Nogami et al. | |
| 2015/0232778 | A1 | 8/2015 | Arai et al. | |
| 2017/0362530 | A1 | 12/2017 | Hirooka et al. | |

(Continued)

FOREIGN PATENT DOCUMENTS

| | | | |
|---|---|---|---|
| CN | 102124088 | A | 7/2011 |
| CN | 103476911 | A | 12/2013 |

(Continued)

OTHER PUBLICATIONS

International Search Report (PCT/ISA/210) with an English translation, and Written Opinion (PCT/ISA/237) mailed on Jun. 15, 2021, by the Japan Patent Office as the International Searching Authority for International Application No. PCT/JP2021/013506.
Wang et al., "Preparation of a Low-Torque, Long-Life Bearing Grease," Petroleum Products Application Research, Jun. 15, 2017, vol. 03, pp. 20-25, with Partial English translation. (9 pages).
Office Action (The First Office Action) issued Jan. 20, 2023, by the National Intellectual Property Administration, P.R. China in corresponding Chinese Patent Application No. 202180024852.2, with partial English translation of the Office Action. (8 pages).

(Continued)

*Primary Examiner* — Vishal V Vasisth
(74) *Attorney, Agent, or Firm* — Panitch Schwarze Belisario & Nadel LLP

(57) ABSTRACT

This ball screw grease composition for a rack-assisted electric power steering contains a thickener, a base oil, and at least one compound selected from the group consisting of a Ca sulfonates, fatty acids, and triglycerides, wherein the kinematic viscosity of the base oil at 40° C. is 4-100 mm2/s, and the worked penetration of the composition is 265-385.

14 Claims, No Drawings

(56) References Cited

U.S. PATENT DOCUMENTS

| | | | |
|---|---|---|---|
| 2019/0185780 | A1 | 6/2019 | Saito et al. |
| 2020/0181528 | A1* | 6/2020 | Kochi ..... C10M 133/42 |

FOREIGN PATENT DOCUMENTS

| | | | |
|---|---|---|---|
| CN | 107109293 | A | 8/2017 |
| EP | 3239281 | A1 | 11/2017 |
| JP | 2001335792 | A | 12/2001 |
| JP | 2003-097571 | A | 4/2003 |
| JP | 2004059814 | A | 2/2004 |
| JP | 2005-132879 | A | 5/2005 |
| JP | 2006057709 | A | 3/2006 |
| JP | 2006077205 | A | 3/2006 |
| JP | 2006-117827 | A | 5/2006 |
| JP | 2006306275 | A | 11/2006 |
| JP | 2006307023 | A | 11/2006 |
| JP | 2006335102 | A | 12/2006 |
| JP | 2008-115304 | A | 5/2008 |
| JP | 2009-185243 | A | 8/2009 |
| JP | 2009-256401 | A | 11/2009 |
| JP | 2010-037530 | A | 2/2010 |
| JP | 2010095631 | A | 4/2010 |
| JP | 2010241858 | A | 10/2010 |
| JP | 2011-046898 | A | 3/2011 |
| JP | 2012-052047 | A | 3/2012 |
| JP | 2012077283 | A | 4/2012 |
| JP | 2014047276 | A | 3/2014 |
| JP | 2015160493 | A | 9/2015 |
| JP | 2018-016687 | A | 2/2018 |
| JP | 2019-094474 | A | 6/2019 |
| JP | 2020172571 | A | 10/2020 |
| WO | 2004037958 | A1 | 5/2004 |
| WO | 2004/081156 | A1 | 9/2004 |
| WO | 2006/078035 | A1 | 7/2006 |
| WO | 2016/104812 | A1 | 6/2016 |

OTHER PUBLICATIONS

Extended European Search Report issued Jul. 27, 2023, by the European Patent Office in corresponding European Patent Application No. 21779270.4.

Office Action (Notice of Reasons for Refusal) issued on Jan. 22, 2024, by the Japanese Patent Office in corresponding Japanese Patent Application No. 2020-062060, and an English translation of the Office Action. (32 pages).

Office Action issued on Dec. 14, 2023, by The State Intellectual Property Office of People's Republic of China in corresponding Chinese Patent Application No. 202180024852.2, with an English translation of the Office Action (11 pages).

Zhang et al., "Grease production", Sinopec Publishing House, Jul. 31, 2003, pp. 256-257, with an English translation (10 pages).

* cited by examiner

BALL SCREW GREASE COMPOSITION FOR RACK-ASSISTED ELECTRIC POWER STEERING

This application is a 371 of PCT/JP2021/013506, filed Mar. 30, 2021.

TECHNICAL FIELD

The present invention relates to a grease composition for a ball screw part of rack-assisted electric power steering.

BACKGROUND ART

In these years, electric power steering has been widely applied in need of responsiveness and quietness during steering as improvements in driving comfort of automobiles. The electric power steering is divided into column-assisted, pinion-assisted, and rack-assisted types and the like, and the demand for the rack-assisted type has been expected to expand in the market of electric power steering in the future because the rack-assisted type has high responsiveness and output. Along with this trend, greases used for ball screw parts in rack-assisted electric power steering devices are also demanded to meet various requests such as an increase in service life, a reduction in torque over a wide speed region, and further, reductions in noise and vibration. Particularly, suppression of torque variations has been an important technological challenge for improving the responsiveness and the quietness while the driver is steering.

Conventional techniques of grease compositions that can be applied to ball screw parts in rack-assisted electric power steering devices include Patent Literatures 1 and 2.

Patent Literature 1 describes a grease composition that use a diurea compound in which an aliphatic moiety has unsaturated components together with a fatty acid metallic salt and an amide compound in a predetermined ratio as a thickener, uses a lubricating base oil containing a synthetic hydrocarbon oil having a pour point of −25° C. or less as a main component as a base oil, and predetermined amounts of predetermined additives. This grease has been reported as a grease having a long service life that can significantly reduce irregular friction variations, exhibits low and stable torque properties in a wide temperature range, and can maintain a sufficient oil film even at a high temperature.

Patent Literature 2 describes a grease composition that uses a mixture of an urea-based compound that has an average molecular weight of 500 to 1000 in which a linear chain hydrocarbon group has an unsaturated component, a fatty acid metallic salt, and an amide compound, as a thickener. This grease has been reported as a grease that can significantly reduce irregular friction variations, and can achieve stable friction properties and lubricity.

CITATION LIST

Patent Literatures

Patent Literature 1: Japanese Patent Application Publication No. 2006-306275

Patent Literature 2: Japanese Patent Application Publication No. 2006-307023

SUMMARY OF INVENTION

Problems to be Solved by the Invention

An object of the present invention is to provide a grease composition for a ball screw part of rack-assisted electric power steering, that suppresses torque variations to improve responsiveness and quietness during steering using a rack-assisted electric power steering device and achieves a low torque even over a wide speed region range.

Means for Solution of the Problems

1. A grease composition for a ball screw part of rack-assisted electric power steering, comprising:
   - a thickener;
   - a base oil; and
   - at least one compound selected from the group consisting of a Ca sulfonate, a fatty acid, and a triglyceride, wherein
   - a kinematic viscosity at 40° C. of the base oil is 4 to 100 $mm^2/s$, and
   - a worked penetration of the composition is 265 to 385.
2. The grease composition according to the above-described 1, wherein the compound is a Ca sulfonate having a base number of 350 mgKOH/g or less.
3. The grease composition according to the above-described 1, wherein the compound is a linear or branched, saturated or unsaturated fatty acid having 6 to 24 carbon atoms.
4. The grease composition according to the above-described 1, wherein the compound is a triglyceride in which an aliphatic moiety of the triglyceride is a linear or branched, saturated or unsaturated fatty acid having 7 to 26 carbon atoms.
5. The grease composition according to any one of the above-described 1 to 4, wherein the base oil contains poly-α-olefin.

Advantageous Effects of Invention

The present invention makes it possible to provide a grease composition for a ball screw part of rack-assisted electric power steering, that can achieve both suppression of torque variation and a low torque over a wide speed region.

DESCRIPTION OF EMBODIMENTS

Thickener

The thickener that can be used in the present invention is not particularly limited. Specifically, for example, the thickener includes soap thickeners represented by a Li soap and a Li complex soap, urea-based thickeners represented by diurea, inorganic thickeners represented by organoclay and silica, organic thickeners represented by PTFE, and the like. Among these, diurea represented by the formula (I) and Li complex soap are more preferable because they are excellent in heat resistance.

$$R_1\text{—NHCONH—}R_2\text{—NHCONH—}R_3 \quad \text{(I)}$$

wherein $R_1$ and $R_3$ may be the same or different, and each represent a straight chain alkyl group having 8 to 20 carbon atoms, an aryl group having 6 or 7 carbon atoms, or a cyclohexyl group, and preferably a straight chain alkyl group having 8 to 18 carbon atoms. $R_2$ is a divalent aromatic hydrocarbon group having 6 to 15 carbon atoms, preferably a group derived from tolylene diisocyanate or diphenylmethane-4,4'-diisocyanate, and more preferably a group derived from diphenylmethane-4,4'-diisocyanate. As the diurea of the formula (I), it is most preferable to contain a compound in which one of $R_1$ and $R_3$ is a straight chain alkyl group having 8 carbon atoms, the other thereof is a straight chain alkyl group having 18 carbon atoms, and $R_2$ is a group derived from diphenylmethane-4,4'-diisocyanate.

The Li complex soap is preferably one composed of a lithium salt of a hydroxy fatty acid having one or more hydroxyl groups and having 12 to 24 carbon atoms and a lithium salt of a fatty dicarboxylic acid having 2 to 12 carbon atoms. The above-described hydroxy fatty acid includes 12-hydroxystearic acid, 12-hydroxylauric acid, 16-hydroxypalmitic acid, and the like. Among these, 12-hydroxystearic acid is preferable. The above-described fatty dicarboxylic acid includes azelaic acid, sebacic acid, oxalic acid, malonic acid, succinic acid, glutaric acid, adipic acid, pimelic acid, suberic acid, undecanedioic acid, and dodecanedioic acid. Azelaic acid is most preferable. The Li complex soap is most preferably one composed of the lithium salt of 12-hydroxystearic acid and the lithium salt of azelaic acid.

The thickener of the present invention is particularly preferably a thickener containing a diurea compound of the formula (I) in which one of $R_1$ and $R_3$ is a straight chain alkyl group having 8 carbon atoms, the other thereof is a straight chain alkyl group having 18 carbon atoms, and $R_2$ is a group derived from diphenylmethane-4,4'-diisocyanate.

The content of the thickener in the composition of the present invention is an amount that makes it possible to adjust the worked penetration of the grease composition of the present invention to within a range of 265 to 385, and is normally 6 to 15% by mass, preferably 7 to 14% by mass, and more preferably 8 to 12% by mass, based on the total mass of the composition.

Base Oil

The type of the base oil of the grease composition of the present invention is not particularly limited. The base oil may be a mineral oil or a synthetic oil. One base oil may be used alone or two or more base oils may be used in combination.

As the mineral oil, a paraffin-based mineral oil, a naphthene-based mineral oil, or a mixture of these can be used.

As the synthetic oil, any of various synthetic oils such as ester-based synthetic oils represented by diesters and polyolesters; synthetic hydrocarbon oils represented by poly-α-olefin (PAO) and polybutene; ether-based synthetic oils represented by alkyl diphenyl ethers and polypropylene glycol; silicone oils, fluorinated oils, and the like can be used.

The base oil preferably contains poly-α-olefin. In the case where the base oil contains a base oil other than poly-α-olefin, the poly-α-olefin may be contained in an amount of preferably 50% by mass or more, more preferably 80% by mass or more, further preferably 90% by mass or more, and most preferably 100% by mass, based on the total mass of the base oil. It is preferable because when the percentage of the poly-α-olefin in the base oil is as described above, an excellent low-temperature performance can be achieved.

The kinematic viscosity of the base oil in the present invention is such that the kinematic viscosity at 40° C. is 4 to 100 $mm^2/s$, preferably 10 to 80 $mm^2/s$, and further preferably 15 to 70 $mm^2/s$, from the viewpoint of the low-temperature performance and the viewpoint of suppressing the torque in high speed region at a low level.

As the base oil of the present invention, PAO having a kinematic viscosity at 40° C. of 15 to 70 $mm^2/s$ is particularly preferable.

The content of the base oil in the grease composition of the present invention is an amount that is normally used for production of greases, and is, for example, 50 to 93.5% by mass, and is preferably 60 to 92.5% by mass, and more preferably 80 to 91% by mass, from the viewpoint of consistency.

Essential Additive

The grease composition of the present invention comprises at least one compound selected from the group consisting of a Ca sulfonate, a fatty acid, and a triglyceride. Among these, a Ca sulfonate and a fatty acid are preferable, and a Ca sulfonate is more preferable.

The fatty acid includes linear or branched, saturated or unsaturated fatty acids having preferably 6 to 24, and further preferably 12 to 18 carbon atoms. A mixture of two or more of these may also be used. A saturated fatty acid is preferable, and a straight chain saturated fatty acid having 12 to 18 carbon atoms is particularly preferable. The preferable specific examples include stearic acid and palmitic acid.

The triglyceride includes triglycerides in each of which a fatty acid residue constituting the triglyceride has preferably 7 to 26, and further preferably 12 to 18 carbon atoms. A mixture of two or more of these may also be used. Preferable specific examples include castor oil collected from natural oils and/or fats and hydrogenated castor oil.

The Ca sulfonate may be neutral or basic, but is preferably neutral. A mixture of two or more of these may also be used. In the case of a basic Ca sulfonate, the base number (in the case of a mixture, the base number of the mixture) is preferably 350 mgKOH/g or less. Preferable specific examples include neutral calcium dinonylnaphthalenesulfonate. Note that in the Specification, the base number is a value measured in accordance with JIS K2501.

As the essential additive of the present invention, neutral calcium dinonylnaphthalenesulfonate is particularly preferable.

Without being bound to any theory, when an additive predetermined herein is used, it is possible to form a coating film on the surface of a ball screw. It is considered that this coating film thus formed contributes to suppression of torque variation.

The content of the essential additive of the present invention is preferably 0.1 to 10% by mass, more preferably 0.5 to 7% by mass, and further preferably 1 to 5% by mass, based on the total mass of the composition. When the additive predetermined herein is contained in a content within this range, it is preferable because torque variation can be effectively suppressed.

Worked Penetration

In the Specification, the term "worked penetration" refers to 60-stroke worked penetration, and can be measured in accordance with JIS K2220 7. The worked penetration of the present invention is 265 to 385, and preferably 285 to 340. A worked penetration of 265 or more is excellent in terms of torque. A worked penetration of 385 or less is excellent in terms of anti-spattering property and anti-rundown property.

The grease composition of the present invention may comprise additives that are normally used for greases as necessary. The content of these additives is normally 0.5 to 35% by mass, and preferably 5 to 25% by mass, based on the total amount of the grease composition. Such additives include, for example, an antioxidant, an inorganic passivator, a rust preventive, an oiliness improver, an antiwear agent, an extreme pressure agent, and a solid lubricant. The grease composition of the present invention preferably contains at least one of an antioxidant, a rust preventive, an oiliness improver, and an extreme pressure agent from the viewpoint of oxidation resistance, rust resistance, boundary lubrication, and durability.

The grease composition of the present invention is applied to a ball screw part of rack-assisted electric power steering. It is preferable that all elements constituting the ball screw are steel.

Examples

<Test Grease>

In poly-α-olefin (PAO), 1 mol of 4',4-diphenylmethane diisocyanate was reacted with 1 mol of octylamine and 1 mol of stearylamine, followed by heating and cooling, and thereafter, additives were blended in a ratio shown in Table 1 or Table 2, followed by kneading using a three roll mill to obtain grease compositions of Examples 1 to 3 and Comparative Examples 1 to 3. Note that % by mass in Table 1 and Table 2 was based on the total mass of each grease composition.

<Test Method>

[Evaluation on Torque at Various Speeds]

To the thread groove portion of a ball screw made of steel, 10 g of each test grease was applied, and the ball screw was placed in a constant temperature oven with ambient temperature set to 25° C. The screw shaft was reciprocated 10 times at a speed of 10 mm/s and within a stroke range of 50 mm. Thereafter, the screw shaft was reciprocated 3 times at a speed of each of 1, 2, 4, 5, 10, and 20 mm/s in order from the lowest speed. This was counted as 1 cycle, and 5 cycles were conducted in total. The force ("operating force") generated by reciprocating the screw shaft of the ball screw at a predetermined speed was sampled at predetermined intervals, and an average value of the operating forces per reciprocation was calculated by dividing the sum of the operating forces per reciprocation by the number of times of sampling the data. The average value in the three times of reciprocation at 1 mm/s and 20 mm/s in the fifth cycle was judged based on the criteria described below to evaluate whether or not a low torque was achieved over a wide speed region.

[Judgment Criteria]

The average value of the operating forces at 1 mm/s was
- less than 55 ◎
- 55 or more and less than 70 ○
- 70 or more and less than 100 Δ
- 100 or more X The average value of the operating forces at 20 mm/s was
- less than 130 ◎
- 130 or more and less than 140 ○
- 140 or more and less than 150 Δ
- 150 or more X

[Evaluation of Torque Variation]

In the above-described evaluation of torques, when the reciprocation was conducted three times at 1 mm/s in the fifth cycle, among variations (peaks) of the operating force generated in the first reciprocation, the first to fifth peak heights in descending order of variation were calculated. In the same manner, the first to fifth peak heights in descending order of variation were calculated for variations generated during the second reciprocation and during the third reciprocation, and an average value of all the 15 peaks was obtained, and evaluated based on the criteria described below.

Note that the reason why the above average value was obtained at the lowest speed among the set speeds is because the effect of the steering wheel being caught, which affects the torque variation, is more likely to occur at a low speed than at a high speed. In addition, an automobile is normally test-driven in the site of the factory, or the like, after the automobile is manufactured at the factory and before the automobile is delivered. That is, it is considered that the event where the steering wheel is caught is lessened so that the steering wheel gets into a stable state by the time of delivery. In the torque test as well, since the steering wheel was reached to a stable state by the fifth cycle at the latest, the grease composition was evaluated from variations at the fifth cycle with the assumption of the drive after the delivery.

[Judgment Criteria]

The average value was
- less than 12 N ◎
- 12 or more and less than 15 ○
- 15 or more and less than 20 Δ
- 20 or more X

TABLE 1

| | | Example 1 | Example 2 | Example 3 |
|---|---|---|---|---|
| Thickener | Type | diurea | diurea | diurea |
| | % by mass | 11.0 | 11.0 | 11.0 |
| Base oil | Type | PAO | PAO | PAO |
| | % by mass | 84.0 | 84.0 | 84.0 |
| Additive | Ca sulfonate | 5.0 | | |
| % by mass | Triglyceride | | 5.0 | |
| | Fatty acid | | | 5.0 |
| Worked penetration | | 300 | 300 | 300 |
| Torque at | 1 mm/s | ◎ | ◎ | ◎ |
| various speeds | 20 mm/s | ◎ | ◎ | ◎ |
| Torque variation | | ◎ | ○ | ◎ |

TABLE 2

| | | Comparative Example 1 | Comparative Example 2 | Comparative Example 3 |
|---|---|---|---|---|
| thickener | Type | diurea | diurea | diurea |
| | % by mass | 11.0 | 11.0 | 11.0 |
| base oil | Type | PAO | PAO | PAO |
| | % by mass | 89.0 | 84.0 | 84.0 |
| Additive | Zn sulfonate | | 5.0 | |
| % by mass | sorbitan fatty acid ester | | | 5.0 |
| Worked penetration | | 300 | 300 | 300 |
| Torque at | 1 mm/s | ◎ | ◎ | ◎ |
| various speeds | 20 mm/s | ◎ | ◎ | ◎ |
| Torque variation | | X | X | X |

PAO: The kinematic viscosity at 40° C. = 30 $mm^2/s$
Ca sulfonate: Calcium alkylnaphthalenesulfonate (Trade name: NA-SUL 729, produced by KING INDUSTRIES, INC., neutral)
Triglyceride: hydrogenated castor oil (Trade name: HCO-I, produced by JAYANTAGRO-ORGANICS LTD.)
Fatty acid: Stearic acid (Trade name: TST, produced by Miyoshi Oil & Fat Co., Ltd.)
Zn sulfonate: Zinc alkylnaphthalenesulfonate (Trade name: NA-SUL ZS, produced by KING INDUSTRIES, INC.)
Sorbitan fatty acid ester: Sorbitan trioleate (Trade name: NONION OP-85R, produced by NOF Corporation)

What is claimed is:

1. A grease composition for a ball screw part of rack-assisted electric power steering, consisting of:
- a thickener;
- a base oil;
- a triglyceride, and
- optionally an additive selected from the group consisting of an antioxidant, an inorganic passivator, a rust preventive, an oiliness improver, an antiwear agent, an extreme pressure agent, and a solid lubricant, wherein
- a kinematic viscosity at 40° C. of the base oil is 4 to 100 $mm^2/s$,
- a worked penetration of the composition is 265 to 385,
- the thickener is represented by formula (I):

$$R_1—NHCONH—R_2—NHCONH—R_3 \quad (I)$$

wherein $R_1$ and $R_3$ may be the same or different, and each represent a straight chain alkyl group having 8 to 20 carbon atoms, $R_2$ is a divalent aromatic hydrocarbon group having 6 to 15 carbon atoms, and the base oil is poly-α-olefin.

2. The grease composition according to claim 1, wherein an aliphatic moiety of the triglyceride is a linear or branched, saturated or unsaturated fatty acid having 7 to 26 carbon atoms.

3. The grease composition according to claim 1, wherein the thickener is a diurea compound of the formula (I) in which one of $R_1$ and $R_3$ is a straight chain alkyl group having 8 carbon atoms, the other thereof is a straight chain alkyl group having 18 carbon atoms, and $R_2$ is a group derived from diphenylmethane-4,4'-diisocyanate.

4. The grease composition according to claim 1, wherein a content of the thickener is 6 to 15% by mass based on a total mass of the composition.

5. The grease composition according to claim 1, wherein a content of the base oil is 50 to 93.5% by mass based on a total mass of the composition.

6. The grease composition according to claim 1, wherein a content of the triglyceride is 0.1 to 10% by mass based on a total mass of the composition.

7. The grease composition according to claim 1, consisting of the additive.

8. The grease composition according to claim 7, wherein a content of the additive is 0.5 to 35% by mass based on a total amount of the grease composition.

9. The grease composition according to claim 1, wherein the triglyceride is hydrogenated castor oil.

10. A grease composition for a ball screw part of rack-assisted electric power steering, consisting of:

a thickener;

a base oil;

a triglyceride, and optionally an additive selected from the group consisting of an antioxidant, an inorganic passivator, a rust preventive, an oiliness improver, an antiwear agent, an extreme pressure agent, or a solid lubricant, wherein a kinematic viscosity at 40° C. of the base oil is 4 to 100 $mm^2/s$, and a worked penetration of the composition is 265 to 385, the thickener is represented by formula (I):

$$R_1—NHCONH—R_2—NHCONH—R_3 \quad (I)$$

wherein $R_1$ and $R_3$ may be the same or different, and each represent a straight chain alkyl group having 8 to 20 carbon atoms, $R_2$ is a divalent aromatic hydrocarbon group having 6 to 15 carbon atoms, the base oil is poly-α-olefin, and the content of the base oil is 80 to 91% by mass based on a total mass of the composition.

11. The grease composition according to claim 10, wherein a content of the thickener is 6 to 15% by mass based on the total mass of the composition.

12. The grease composition according to claim 10, wherein a content of the triglyceride is 0.1 to 10% by mass based on the total mass of the composition.

13. The grease composition according to claim 10, wherein worked penetration of the composition is 285 to 340.

14. The grease composition according to claim 1, wherein worked penetration of the composition is 285 to 340.

* * * * *